United States Patent [19]

Hansen et al.

[11] 4,064,427

[45] Dec. 20, 1977

[54] SAFETY GUARD AND LIGHT FIXTURE ATTACHMENT FOR CEILING FANS

[75] Inventors: Ray W. Hansen, Cape Coral; Walter P. Pouchert, Fort Myers, both of Fla.

[73] Assignee: Hansen Mfg. Co. of Florida, Inc., Cape Coral, Fla. ; a part interest

[21] Appl. No.: 603,950

[22] Filed: Aug. 12, 1975

[51] Int. Cl.[2] ..... F21V 33/00

[52] U.S. Cl. ..... 362/96; 417/424; 415/121 G

[58] Field of Search ..... 240/2 R, 2 V, 78 R, 240/78 F, 78 E; 415/121 G; 417/423, 424

[56] References Cited

U.S. PATENT DOCUMENTS

| | | | |
|---|---|---|---|
| 1,222,837 | 4/1917 | Winslow et al. | 417/423 |
| 1,394,667 | 10/1921 | Corbin | 415/121 G |
| 1,680,094 | 8/1928 | Doane | 240/78 F |
| 1,776,991 | 9/1930 | Biette | 240/2 V |
| 1,781,155 | 11/1930 | Anderson | 417/424 |
| 1,940,318 | 12/1933 | Morse | 415/121 G |
| 2,087,240 | 7/1937 | Brown | 240/2 V |
| 2,258,731 | 10/1941 | Blumenthal | 240/2 V |
| 2,603,738 | 7/1952 | Schubert et al. | 240/78 R X |
| 2,710,337 | 6/1955 | Moore | 240/78 R |
| 3,001,056 | 9/1961 | Spear | 240/2 V |

*Primary Examiner*—L. T. Hix
*Assistant Examiner*—Alan Mathews
*Attorney, Agent, or Firm*—Clarence A. O'Brien; Harvey B. Jacobson

[57] ABSTRACT

A safety guard and light fixture attachment for ceiling fans in the form of an annular ring encircling the ceiling fan in alignment with and guarding relation to the fan blade tips with the ring having a plurality of light fixtures mounted thereon in order to convert a ceiling fan to an attractive and unique light fixture and provide a safety guard for the fan blades. The ring is supported from an adapter oriented on top of the ceiling fan motor with a plurality of radial tubular supporting members interconnecting the adapter and ring with the tubular supporting members and the ring having passageways for electrical wiring. Downwardly diverging flexible supporting elements interconnect the ring and a supporting member at the ceiling to stabilize the ring and further add to the unique attractive appearance of the attachment.

9 Claims, 6 Drawing Figures

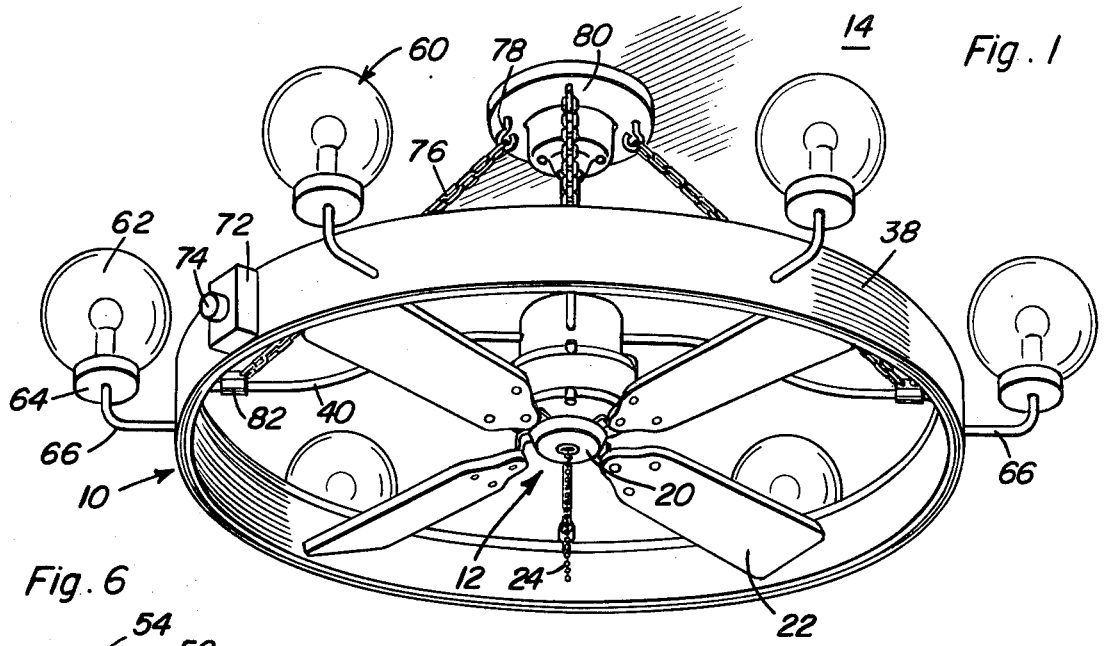
Fig. 1
Fig. 6
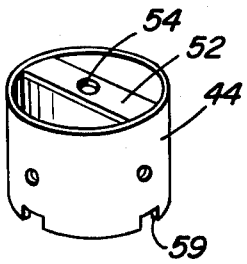
Fig. 2
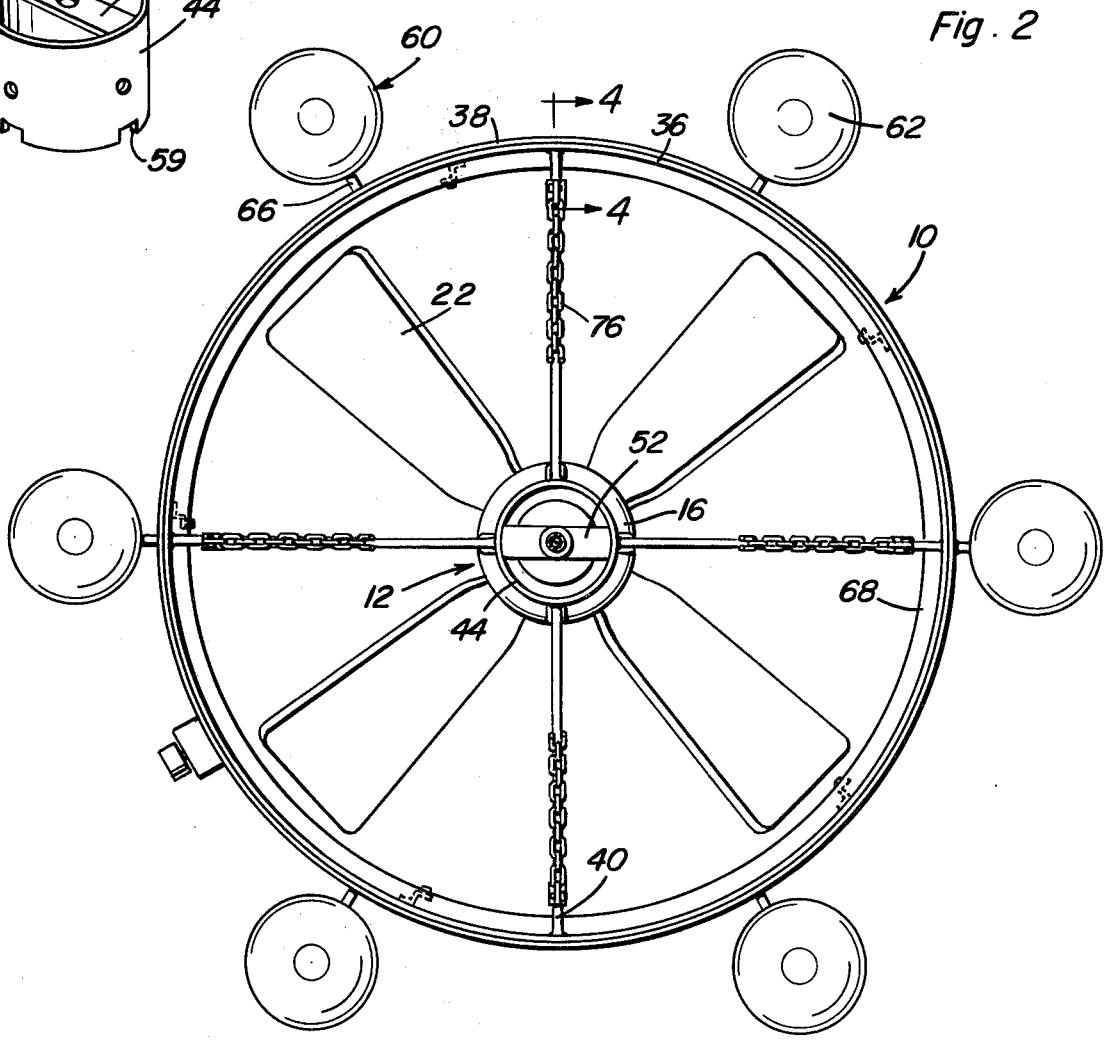

14
16
18
20
22
24
26
28
30
32
34
36
38
40
42
44
46
48
50
52
56
57
58
60
62
64
66
68
69
70
76
78
80
82
5

SAFETY GUARD AND LIGHT FIXTURE ATTACHMENT FOR CEILING FANS

BACKGROUND OF THE INVENTION

1. Field of the Invention

The present invention generally relates to a combined safety guard and light fixture associated with a conventional ceiling fan to prevent contact with the tips of the rotating blades and provide an attractive light fixture utilizing a plurality of circumferentially spaced light fixtures of any desired configuration and appearance, thereby not only enhancing the appearance characteristics of the ceiling fan, but also providing a guard for the fan and a utilitarian light fixture.

2. Description of the Prior Art

Ceiling fans have been employed for many years to circulate air in an enclosure and such fans conventionally employ a suspended motor with radially extending blades connected to the output shaft with the blades being completely unguarded. Usually such fans are suspended at a height sufficient to eliminate a hazard to persons occupying or passing through the enclosure. However, in some instances, such fans do present a hazard especially in view of relatively low ceilings in present day building construction. One example of such a hazard exists when an adult carries a small child in an elevated position, such as frequently might occur in a restaurant, store, or the like. such as if the child were positioned on the shoulders of an adult. Also, such fans occupy a relatively large ceiling space and are not attractive in appearance, although some effort has been made to render such fans more attractive. Usually, the fan motors are of the two-speed type with a central pull chain being provided to turn the fan motor on or off or change its speed. One type of ceiling fan has a center light oriented at the lower end of the motor shaft or at the fan hub, but since it cannot depend to any appreciable extent below the fan, the light is relatively ineffective for illumination purposes and adds very little to the appearance characteristics of the fan.

SUMMARY OF THE INVENTION

An object of the present invention is to provide a safety guard and light fixture for ceiling fans in the form of an attachment comprising an annular ring of generally cylindrical configuration disposed in encircling relation to the fan blades in close proximity thereto with the ring having a vertical dimension to extend a short distance above and below the path of the fan blade tips, together with a plurality of light fixtures supported externally of the ring, in order to provide a guard for the fan and a light fixture suspended from the ceiling thereby producing only a utilitarian light fixture but also enhancing the appearance characteristics of the ceiling fan and providing a very attractive suspended ceiling light fixture.

Another object of the invention is to provide a safety guard and light fixture for ceiling fans in accordance with the preceding object in which the external surface of the ring is provided with a decorative material applied thereto, such as by lamination, or the like, in order to provide a desired color or other decorative feature to the attachment.

A further object of the invention is to provide a safety guard and light fixture in which the guard in the form of an annular ring is supported from the ceiling fan motor housing and associated supporting structure by an adapter having a plurality of rigid tubular supports extending therefrom and rigidly connected to the annular ring to only only support and center the annular ring but also provide passage for electrical wiring for supplying electrical energy to the light fixture supported on the ring.

Still another object of the invention is to provide a safety guard and light fixture in accordance with the preceding objects in which a plurality of of downwardly diverging flexible support members, such as chains, extend from the ring upwardly and inwardly to a point of support at the ceiling, thereby further stabilizing the ring and further enhancing the appearance characteristics of the combined suspended ceiling fan and light fixture.

A still further significant feature of the invention is to provide a combined guard and light fixture attachment for a ceiling fan in which the particular configuration of the light fixtures may vary to provide a desired decorative theme and a dimmer switch may be optionally provided on the periphery of the guard to vary the illumination characteristics of the light fixture and, if desired, the switch may be provided on the periphery of the ring for controlling the fan motor.

Yet another important object of the present invention is to provide a safety guard and light fixture attachment for ceiling fans which eliminates any possibility of injury due to contact with the periphery of the fan blades, provides a unique and attractive light fixture associated peripherally of the fan and is relatively inexpensive to manufacture and quite easy to assemble in relation to a conventional ceiling fan.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the safety guard and light fixture attachment associated with a conventional ceiling fan illustrating the relationship of the annular ring around the fan blade and the light fixture supported therefrom.

FIG. 2 is a plan view of the assembly of FIG. 1 illustrating the association of the components of the present invention with the fan.

FIG. 6 is a perspective view of the adapter unit which is placed on the upper surface of the ceiling fan motor.

DESCRIPTION OF THE PREFERRED EMBODIMENT

Figures 3, 4, 5:
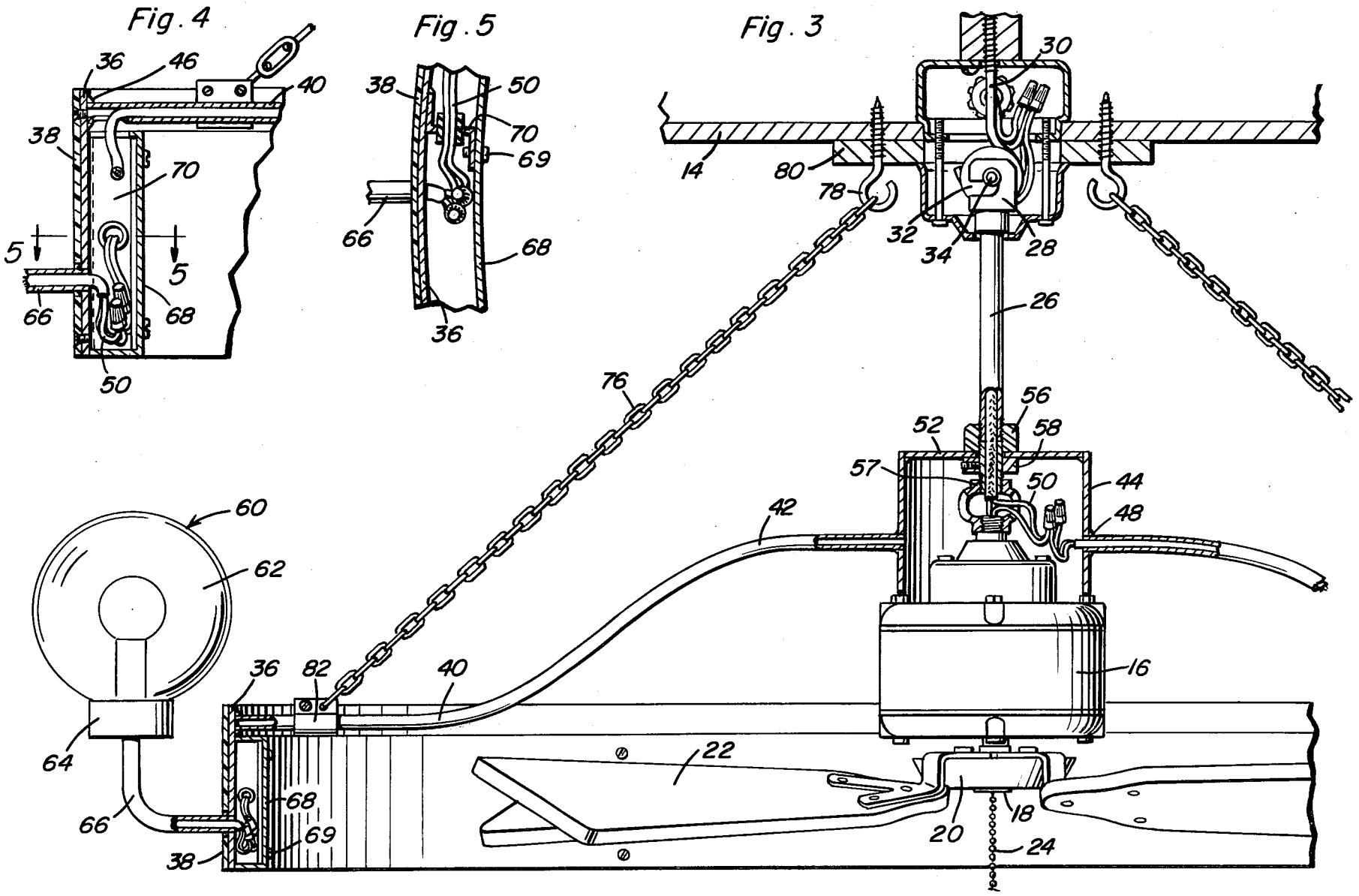
FIG. 3 is a vertical sectional view of the assembly, on an enlarged scale, illustrating in more detail the specific structure of the attachment and its association with the components of the ceiling fan.
FIG. 4 is a detailed sectional view of the annular ring illustrating the laminated decorative material on the external surface thereof, the supporting structure therefor and the passageway formed therein for receiving electrical wiring.
FIG. 5 is a horizontal sectional view illustrating further specific structural details of the annular ring.

Referring now specifically to the drawings, the safety guard and light fixture attachment of the present invention is generally designated by reference numeral 10 and, as shown in FIGS. 1–3, the attachment 10 is associated with a conventional ceiling fan 12 which is supported in suspended relation below a ceiling 14 in a well known and conventional manner. The ceiling fan 12 includes a motor 16 having an output shaft 18 provided with a fan hub 20 and a plurality of radial blades 22 fixed thereto, with the tips of the blades being free and normally unguarded and the blades having a desired pitch to circulate air axially in relation to the rotational axis of the fan motor. Usually, a pull chain 24 is provided for turning the motor on or off or changing the output speed thereof inasmuch as such fans usually are provided with two speeds. The fan motor 16 is supported from the ceiling by a vertical tubular conduit 26 having hook adapters 28 on the upper end thereof for engagement with a supporting hook 30. The supporting hook 30 is suspended from the ceiling structure in a conventional manner and includes an adapter unit 32 with projecting pins 34 for detachably receiving the pair of hooks 28 on the upper end of the support member 26, with all of this structure being conventional in supporting a suspended ceiling fan.

The safety guard and light fixture attachment for ceiling fans 10 includes an annular ring 36 of sheet metal, or the like, which has a vertical dimension slightly greater than the vertical dimension of the tips of the fan blades and has a diameter slightly greater than the circle defined by the tips of the fan blades with the ring 36 being substantially cylindrical and accurately positioned in concentrically and outwardly spaced relation to the tips of the fan blades, as illustrated in FIGS. 1–3. The exterior surface of the ring 36 is provided with a decorative covering 38 which may be in the form of a decorative sheet of material bonded or laminated to the ring 36. For example, a pressure laminated material, such as sold under the trademark "Formica", may be laminated to the exterior of the ring 36 thereby providing a decorative and attractive appearance to the ring.

Rigidly affixed to the inner surface of the ring 36 adjacent the upper edge thereof is a plurality of rigid tubular members 40 which extend radially inwardly in a generally horizontal direction for a substantial portion of their length with the inner end thereof being upwardly curved and offset as indicated by numeral 42. The inner ends of the rigid tubes 40 are connected with a cylindrical adapter 44. The outer end of the tube 40 is rigidly affixed to the ring 36 as by welding 46 and the inner end of the tube 40 is rigidly affixed to the adapter 44 as by welding 48 with the tubular member 40 communicating with the interior of the cylindrical adapter 44 for receiving electrical wiring 50 therethrough. The adapter 44 includes a transverse bar 52 at its upper end having a central opening 54 receiving a coupling 56 attached to the tubular support 26 with a nut 58 fixedly attaching the adapter 44 thereto and also fixedly securing the adapter 44 against the ceiling fan motor 16 to provide a rigid unit so that the tubular members 40 will support the ring 36 concentrically in relation to the fan and in rigid association therewith. The coupling 56 and nut 58 are threaded downwardly on nipple 57 to tighten the adapter 44 rigidly against the motor housing with notches 59 straddling bolt heads on the motor.

The periphery of the safety guard defined by the ring 36 is provided with a plurality of light fixtures generally designated by numeral 60 and which includes the usual decorative globe 62, bulb, fixture and base assembly 64 and a supporting tube 66 extending between the ring 36 and the base assembly 64. As illustrated, the light fixtures 60 are supported laterally outwardly of and slightly upwardly of the ring 36 but it is pointed out that these light fixtures may be of any desired configuration oriented in any desired relationship to the ring. For example, the light fixtures could be mounted directly on the ring or suspended slightly below the ring, as desired. The supporting structure for the light fixture is fixed to the ring and communicated with the interior thereof, as illustrated in FIG. 4, for passage of the electrical wiring 50 to the light fixture. Attached to the inner surface of the ring 36 is a channel-shaped member 68 defining a raceway for the electric wiring 50 with the channel-shaped member 68 being reinforced and rigidly secured to the ring 36 by a plurality of Z-shaped spacers 70 which extend vertically throughout the height of the channel-shaped raceway 68 at circumferentially spaced points around the ring 36. The spacers are spot welded to the ring 36 and the channel raceway is secured against the inner surface of the ring 36 by sheet metal screws 69, or the like.

Also, provided on the exterior of the ring 36 is a switch box 72 having a control knob 74 thereon which may be a conventional dimmer switch to control the light fixtures 60. Optionally, any other suitable control for the light fixture may be provided and, if desired, a control for the fan motor may be also provided on the periphery of the ring or at any other suitable location.

A plurality of flexible chains 76 stabilize and support the ring 36 with the upper ends of the chains 76 being connected to supporting hooks 78 attached to a ceiling plate 80 with the hooks also being connected to the underlying ceiling supporting structure in the same manner as the supporting hook 30. The lower end of each chain is attached to a split clamp 82 mounted on the tube 40 which enables the split clamp to be loosened and moved adjustably along the tubing 40 to vary the effective length of the chain 76 thereby placing equal supporting tension on each of the chains 76 in order to stabilize and maintain the fixture in a level condition and to prevent vibration thereof even though the fan may not be accurately balanced.

The number of supporting tubes 40, light fixtures 60 and supporting chains vary in number depending upon the installational requirements and desires and also depending upon the size characteristics of the fan. For example, if the fan diameter is 36 inches, four supporting tubes and chains may be adequate, whereas if the diameter of the fan is 52 inches, additional supporting tubes and chains may be used. Also, the number of light fixtures 60 may vary depending on the size of each fixture and the size of the annular ring 36. The supporting tubes 66 may be releasably connected to the ring 36 by a standard conduit coupling and a covering canopy may be provided where the tube 66 joins with the ring 36 in order to enable an electrical connection to be made. Also, standard electrical connections, insulating grommets, and the like, are incorporated into the device for proper and safe operation of the device.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A safety guard and light fixture attachment for ceiling fans comprising an annular ring adapted to concentrically encircle a ceiling fan to prevent accidental contact with the tips of the blades of the fan, means supporting said ring in concentric aligned relation with the tips of the blades of the ceiling fan, and light fixture means supported on said ring for illuminating an area peripherally of the fan, said annular ring having a vertical height slightly greater than the pitch of the fan blades at the tips thereof, said supporting means including a plurality of rigid members extending radially inwardly from said ring, and a central adapter connected with the said radial members, said adapter including means adapted for supporting engagement with a ceiling fan support, said radial members being tubular for receiving electric wires for supplying electrical energy to the light fixture means, said annular ring including an annular raceway on the inner surface thereof in communication with the radial support members for receiving electrical wiring, said light fixture means including a plurality of light fixtures secured to the annular ring and including a tubular support member receiving electrical wiring from the raceway.

2. The structure as defined in claim 1 wherein said support means also includes a plurality of upwardly extending and inwardly converging flexible supporting chains having the upper ends thereof secured to a ceiling and the lower ends adjustably secured to the radial support members adjacent the annular ring to enable supporting stabilization of the annular ring from an overhead ceiling supporting structure.

3. The structure as defined in claim 2 wherein said annular ring is provided with a dimmer switch mounted thereon for controlling electrical energy supplied to the light fixtures.

4. The structure as defined in claim 1 wherein said annular ring is generally cylindrical in configuration and provided with an exterior decorative finish, said tubular radial members including upwardly offset inner end portions connected with the adapter for positioning the radial members above the fan blades to enable rotation thereof without interference.

5. In combination with a ceiling fan having a motor suspended in spaced relation below an overhead ceiling and a plurality of radial, axial flow fan blades driven thereby and terminating in unguarded tips, said blades extending radially from a central hub with each blade having a longitudinal dimension substantially greater than the transverse dimension, and annular generally cylindrical ring disposed in concentric, aligned relation to the blade tips, said ring having a vertical dimension approximately equal to the pitch of the blades to prevent movement of an object radially into engagement with the blade tips, light fixture means supported on said ring and means supporting said ring in close, concentric, outwardly spaced relation to the blade tips, said means supporting said ring including a plurality of radially disposed support members, each of said support members having the outer end thereof rigidly connected with the annular ring, an adapter rigidly interconnecting the inner ends of said radial support members, said adapter being supported above the suspended fan motor with the radial support members having a portion thereof inwardly of the outer ends upwardly offset to enable rotation of the fan blades without interference.

6. In combination with a ceiling fan having a motor suspended in spaced relation below an overhead ceiling and a plurality of radial, axial flow fan blades driven thereby and terminating in unguarded tips, said blades extending radially from a central hub with each blade having a longitudinal dimension substantially greater than the transverse dimension, an annular ring disposed in concentric, aligned relation to the blade tips to prevent movement of an object radially into engagement with the blade tips, and means supporting said ring in close, concentric, outwardly spaced relation to the blade tips, said means supporting said ring including a plurality of radially disposed support members, each of said support members having the outer end thereof rigidly connected with the annular ring, an adapter rigidly interconnecting the inner ends of said radial support members, said adapter being supported above the suspended fan motor with the radial support members having a portion thereof inwardly of the outer ends upwardly offset to enable rotation of the fan blades without interference, said support means also including a plurality of flexible tension members having the lower ends thereof adjustably secured to the radial support members adjacent the outer ends thereof, said flexible tension members converging upwardly and inwardly with the upper ends thereof being supported from an overhead ceiling for stabilizing and supporting the fan, fan motor and annular ring.

7. The structure as defined in claim 6 together with at least one light fixture supported from said ring, said radial support members being tubular for receiving electrical wiring extending to said light fixture, said adapter being in the form of a tubular member providing a junction box for connecting the electrical wiring to the light fixture with the electrical wiring for the ceiling fan motor.

8. The structure as defined in claim 7 wherein said annular ring is substantially cylindrical in configuration and having a vertical height slightly greater than the pitch of the blade tips, said light fixture including a tubular support arm projecting radially outwardly from the annular ring and rigidly secured thereto for receiving electrical wiring therethrough.

9. The structure as defined in claim 8 wherein said annular ring includes an inner raceway defining an interior passageway for electrical wiring, and a plurality of reinforcing brackets interconnecting the raceway and annular ring for rigidifying the raceway and annular ring with said brackets including apertures therethrough receiving electrical wiring.

* * * * *